US005441258A

United States Patent [19]

Pagan

[11] Patent Number: 5,441,258

[45] Date of Patent: Aug. 15, 1995

[54] RACKET STRING ALIGNMENT TOOL

[76] Inventor: Salvador E. Pagan, 2830-245th Place SE., Issaquah, Wash. 98027

[21] Appl. No.: 288,292

[22] Filed: Aug. 10, 1994

[51] Int. Cl.[6] ..... A63B 49/00

[52] U.S. Cl. ..... 273/73 D; 273/73 R

[58] Field of Search ..... 273/73 R, 73 A, 73 D

[56] References Cited

U.S. PATENT DOCUMENTS 4,733,866 3/1988 Herbert ..... 273/73 R
4,989,864 2/1991 Ubl ..... 273/73 R X

FOREIGN PATENT DOCUMENTS 2616669 12/1988 France ..... 273/73 D
2620945 3/1989 France ..... 273/73 D
2641700 7/1990 France ..... 273/73 D
2661102 10/1991 France ..... 273/73 D

*Primary Examiner*—Raleigh W. Chiu
*Attorney, Agent, or Firm*—H. Albert Richardson

[57] ABSTRACT

A tool for aligning the strings of a racket, the tool having a base, a support bracket attached to the base for pivotally securing the racket to the base, a positioning pin for positioning the racket in a predetermined location on the base, and an array of spaced alignment pins projecting upward from the base for aligning the racket strings in predetermined positions.

10 Claims, 6 Drawing Sheets

RACKET STRING ALIGNMENT TOOL

BACKGROUND OF THE INVENTION

This invention relates generally to sporting goods and more particularly to a tool for aligning the strings of a racket, especially a tennis racket.

Tennis rackets are designed and constructed so that the strings are oriented in a predetermined pattern. A typical racket as illustrated in FIG. 6 and generally designated by the number 10 has a racket head 12, a handle 14 attached to the head and a string array 16 extending across head opening 18 of the head. The racket can be visualized as having a longitudinal axis A—A extending centrally through handle 12 and through the plane of the string array. The string array has a first group of strings, each attached to the head at two points and extending across the head opening nominally parallel to the longitudinal axis. The strings are not uniformly spaced but instead are more closely spaced near the geometric center of the head opening. The racket also includes a second group of strings, each also attached to the head at two points and extending across the head opening nominally perpendicular to the longitudinal axis. As with the longitudinally extending group they are not uniformly spaced but are more closely spaced near the geometric center of the racket. The strings of the two groups are woven together so that each string of group two will pass on opposing sides of adjacent strings of group one. Because of the varied spacing of the strings of groups one and two, they form an array of openings such as opening 19 which are rectangular but generally not square.

It is well known that as a racket is used in play the strings, particularly those in the central portion of the head opening, are deflected from their nominal or aligned positions by repeated glancing blows of tennis balls. Although the affects of misaligned strings may not be noticeable to players of ordinary skill, it is both discernable and objectionable to more highly skilled players. Previously, the only way to realign the strings was to move them manually one at a time back into a position of approximately correct alignment. Although only the strings in the central portion of the head opening need be repositioned, this process is tedious and time consuming, particularly if it must be done between games or sets.

Accordingly, it is an object of this invention to provide for a tool which will accurately restore a portion of the strings of a tennis racket to their nominal or correctly aligned positions.

It is a further object of this invention to provide such an alignment tool which will realign the strings in the central portion of the racket head opening.

It is yet another object of this invention to provide for such a tool which will realign the strings quickly and in a single operation.

It is a further object of this invention to provide a lightweight and portable string alignment tool which can be conveniently carried to the court and used whenever necessary by players.

SUMMARY OF THE INVENTION

This invention can be broadly summarized as providing for a tool for aligning the strings of a racket. The tool including a base, means attached to the base for positioning the racket head in a predetermined location on the base, and a plurality of spaced alignment pins projecting from the base for aligning the strings in predetermined positions with respect to the head.

According to a more detailed aspect of the invention the positioning means includes a support bracket attached to the base for pivotally securing the racket head to the base.

According to another detailed aspect of the invention the plurality of pins includes a first linearly arranged group of pins and a second linearly arranged group of pins oriented parallel to the first group where the pins of the second group are staggered with respect to the pins of the first group.

Finally, according to an alternate embodiment of the invention the means for positioning includes a plurality of spaced guides for engaging the racket head.

DETAILED DESCRIPTION OF THE PREFERRED EMBODIMENTS

The novel features believed to be characteristic of this invention are set forth in the appended claims. The invention itself, however, may be best understood and its various objects and advantages best appreciated by reference to the detailed description below in connection with the accompanying drawings.

Figure 1:
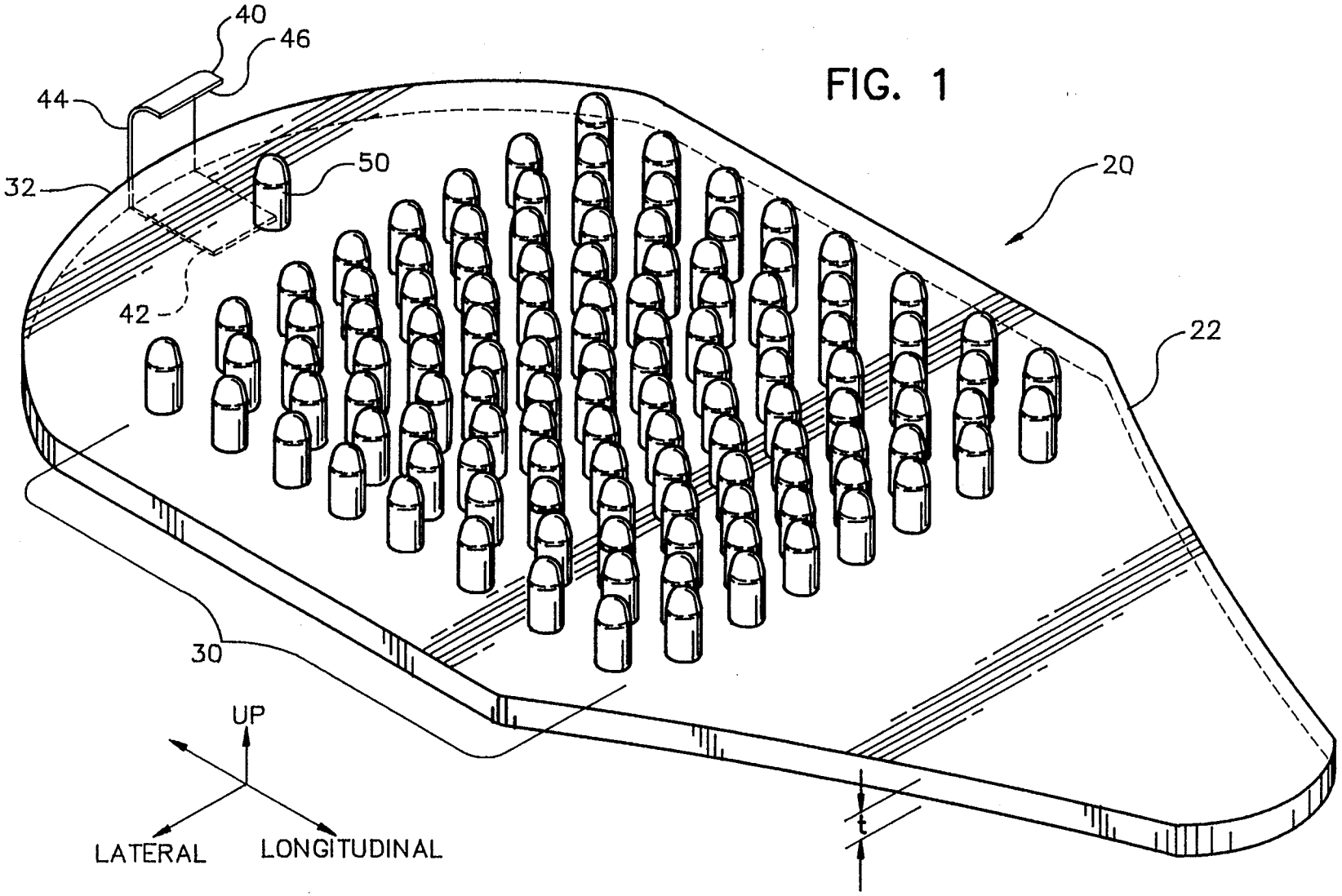
FIG. 1 is a perspective view of the invention.
Figure 2:
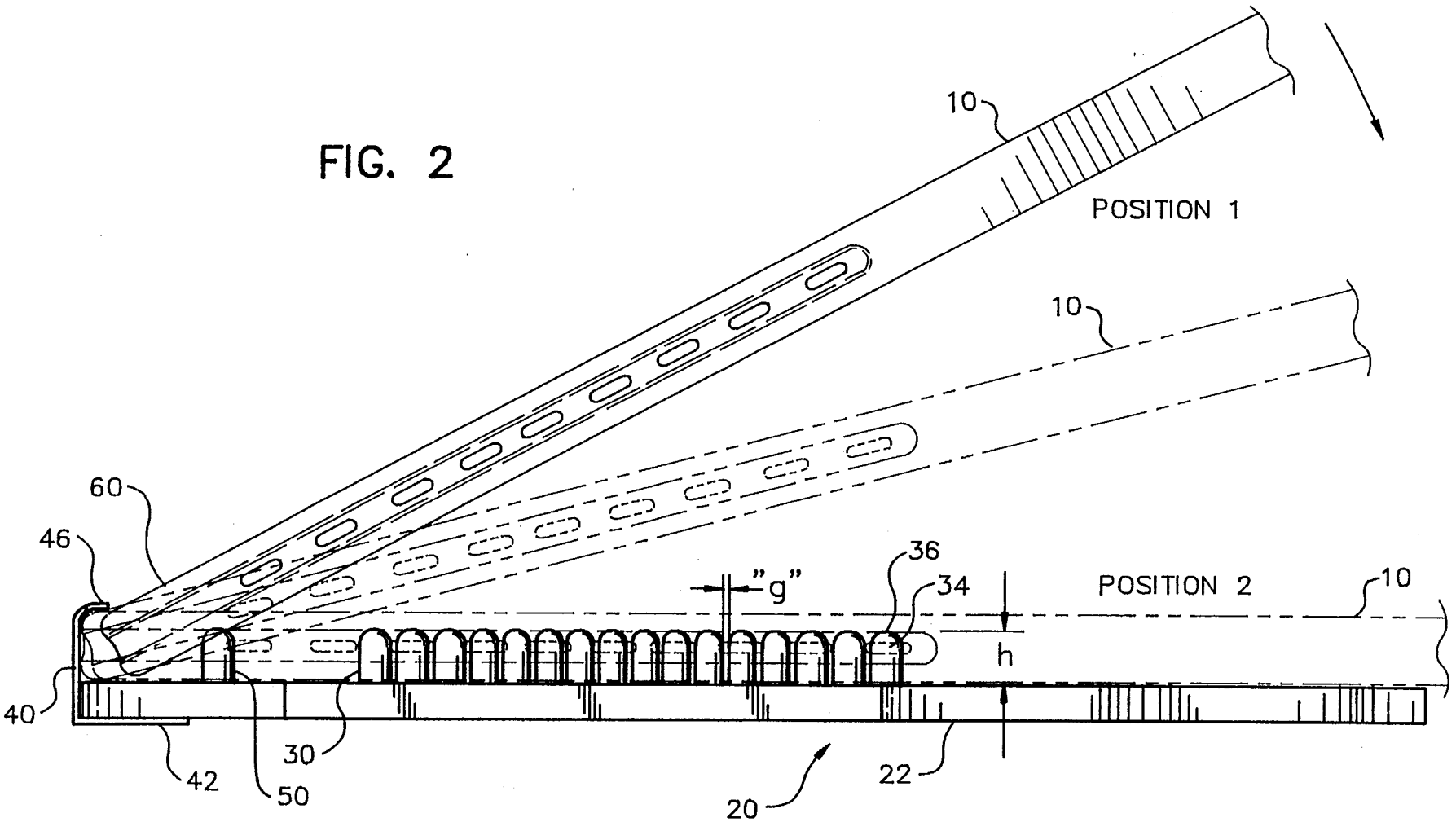
FIG. 2 is a side view of the alignment tool of FIG. 1 including partial phantom views of the racket of Figure A in various operational positions on the tool.
Figure 3:
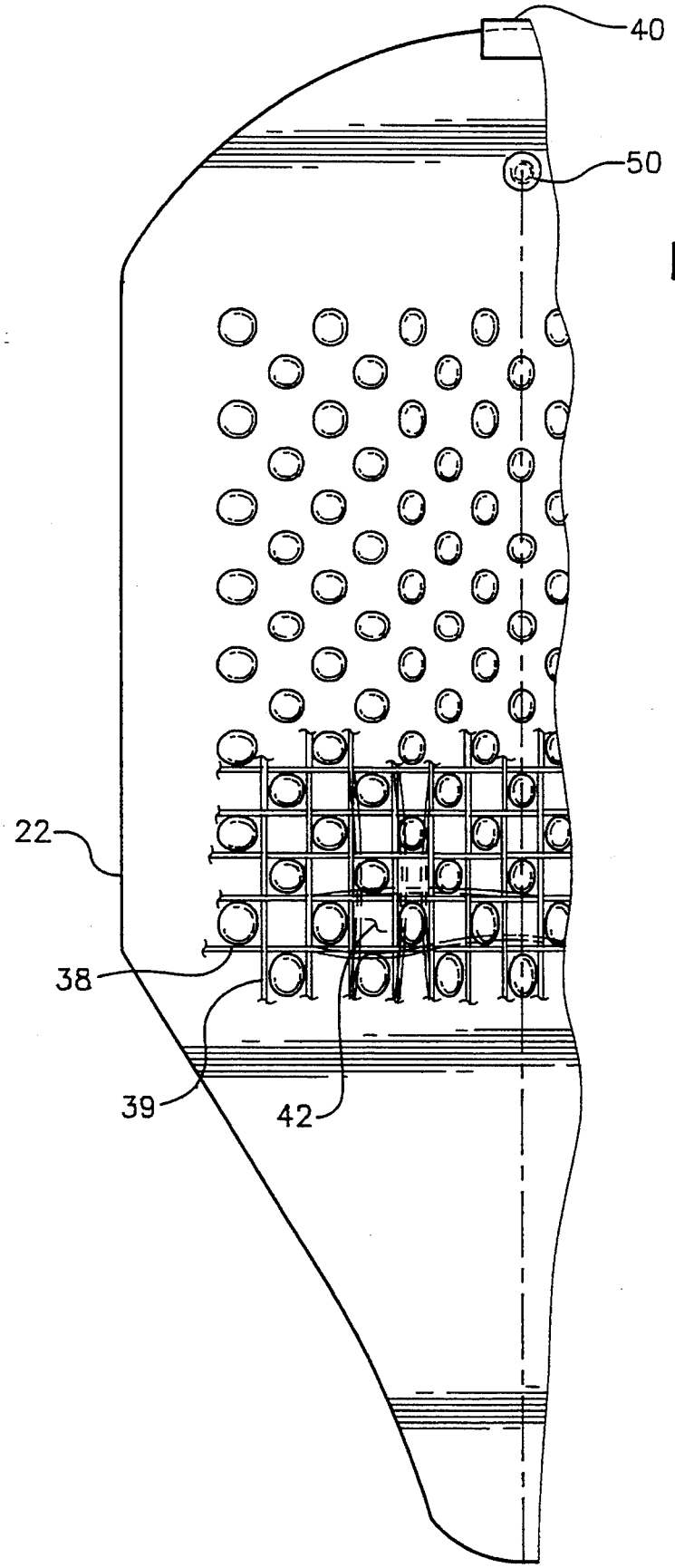
FIG. 3 is a partial top view of the invention including a portion of a racket string array as it would be positioned on the tool.
Figure 4:
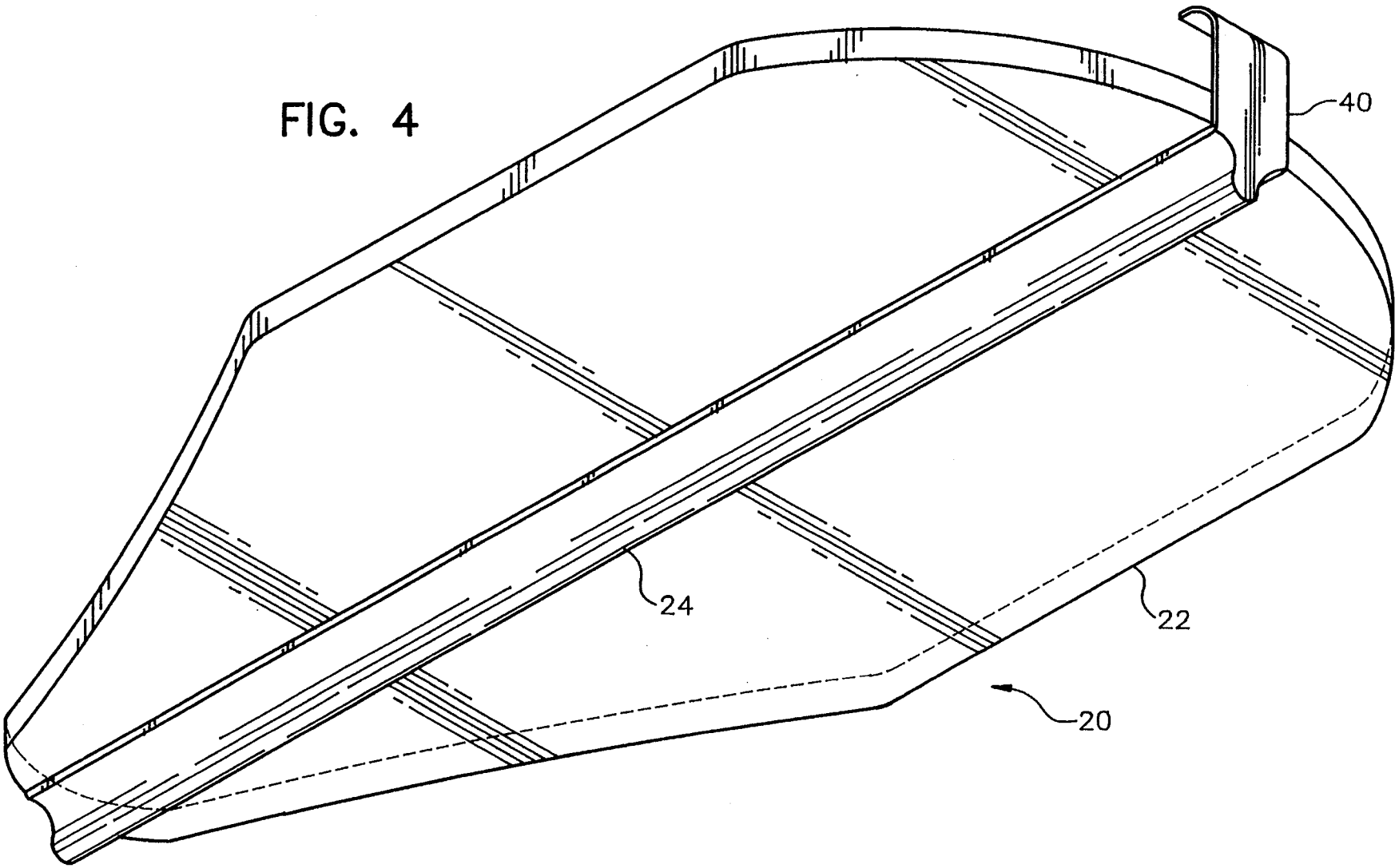
FIG. 4 is a bottom perspective view of the tool of FIG. 1.

A tool for aligning the strings of a racket according to the teachings of the present invention is illustrated in FIGS. 1–5 and generally designated by the number 20. The tool includes base 22 which is preferably molded from a durable impact resistant plastic. The base has a nominal thickness "t" of 0.25" and is reinforced by longitudinally extending rib 24 which is integrally molded in the underside of the base as shown in FIG. 4. The rib also functions as a convenient grip during use.

Referring again to FIG. 1, the tool also includes a plurality 30 of spaced alignment pins each of which is integrally cast in the base. In the preferred embodiment the alignment pins are arranged in eight laterally oriented, longitudinally spaced rows. Moreover, pins in adjoining rows are laterally staggered so that pins in alternate rows also form longitudinally oriented rows. Preferably the laterally oriented row nearest front 32 of the base contains eight spaced alignment pins, the adjacent row contains seven pins, the next adjacent row contains eight pins and so forth. The inventor believes that this arrangement of pins will align the most significant portion of the string array but obviously other arrangements are possible.

As shown in FIG. 2, each of the alignment pins such as pin 34 projects generally upward from base 22 and its upper portion 36 is smoothly rounded. The height "h" of the alignment pins should be such that when the racket is seated on the base, rounded portion 36 of the pins should extend just above the string array. Lateral rows of pins are spaced apart by gaps "g" which are just sufficient to permit a racket string to pass therebetween. FIG. 3 illustrates a partial top view of the tool over which a partial array of racket strings such as strings 38 and 39 has been positioned. In order for a group of alignment pins to properly align the string array each pin must be shaped so as to contact each of the four strings which surrounds it. Accordingly, the pins differ in cross sectional shape depending upon their respective positions in the pin array. While some pins may be circular in cross section they are more typically elliptical. Also, because the configuration of string arrays varies from manufacturer to manufacturer, the tool must be designed to conform to the array of a particular racket.

Another important aspect of this invention is the means employed for properly positioning and securing the racket head on the tool. Again, because the string spacing varies laterally and longitudinally over the string array, it is important that the racket be aligned in a particular predetermined position on the tool before string alignment is attempted. In the embodiment of FIGS. 1–4, the particular means employed for aligning the racket includes support bracket 40 which is centrally positioned at head 32 of base 22. The bracket includes bottom portion 42, vertical portion 44 and lip 46. Although in the preferred embodiment the bracket is formed separately from the base and attached to it by fasteners (not shown), it can also be molded integrally with the base. The positioning means also includes positioning pin 50 which projects upward from the base just aft of bracket 40. In order to assist the player in aligning the racket on the base, strings which contact pin 50 may be colored. Also, markings may be placed on the forward end of the racket head at the position where it should contact bracket 40.

In operation, in order to begin the alignment procedure the player should insert forward end 60 of the racket head under lip 46 of the support bracket as shown in position 1 in FIG. 2. Lateral alignment of the racket head with respect of the support bracket should be determined by alignment of markings on the head with the bracket and/or by alignment of appropriate strings with the positioning pin. Next, the racket should be rotated downward by its handle keeping it longitudinally aligned along the board, and positioning pin 50 should pass between the appropriate strings to assure proper lateral alignment of the head. Finally, when the racket is rotated into a position where it is seated on the base as shown in position 2, the desired central portion of the string array will be properly aligned.

Figure 5:
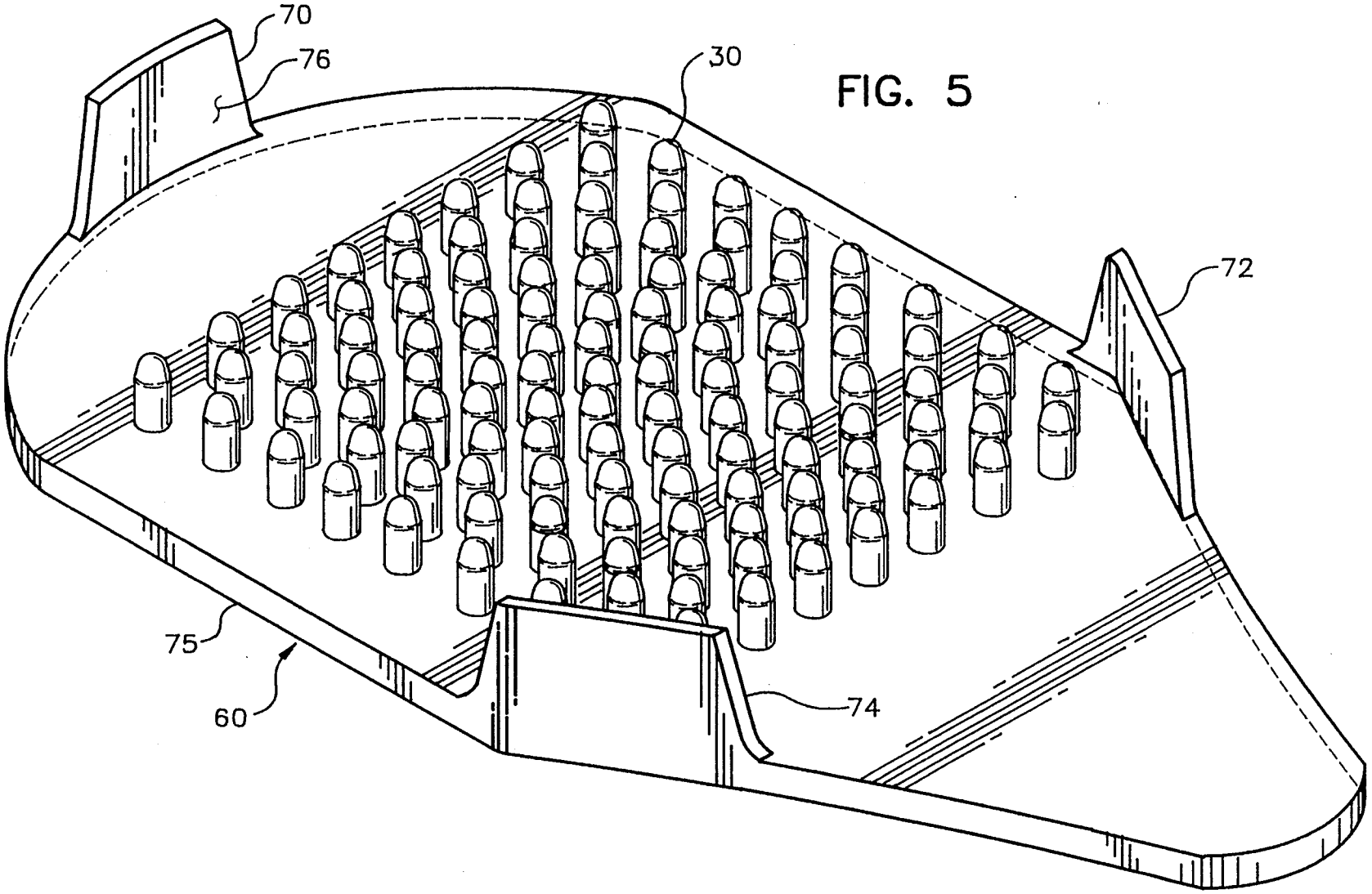
FIG. 5 is a top perspective view of a second embodiment of the invention.
Figure 6:
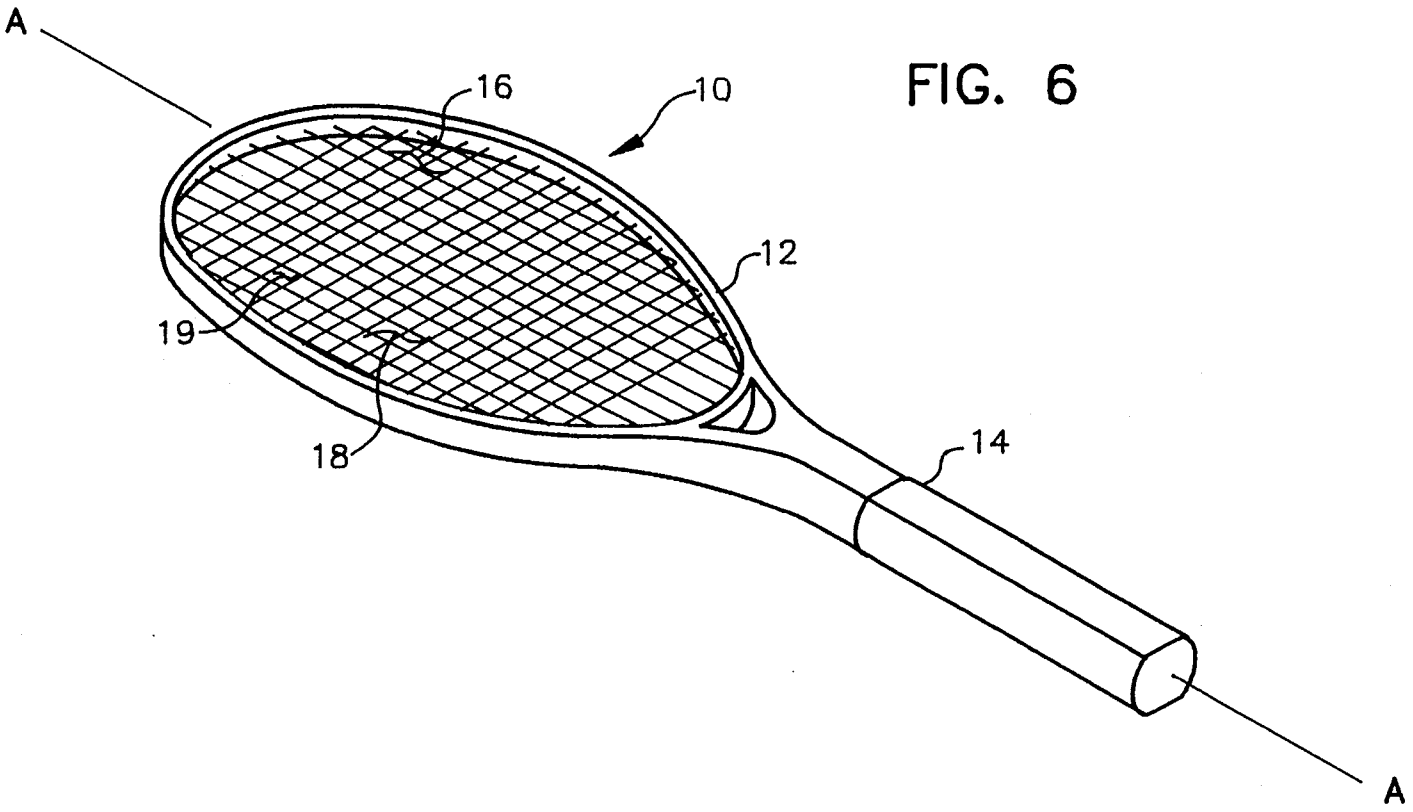
FIG. 6 is a perspective view of a typical tennis racket.

FIG. 5 illustrates an alternate embodiment 60 of the present invention. In this embodiment the positioning means includes a plurality of spaced and vertically oriented guide members 70, 72 and 74. Member 70 is positioned at the head 71 of the racket and members 72 and 74 are positioned on opposing sides of the base 75 near the rear of the pin array. The inner surfaces of the guide members such as surface 76 are contoured and oriented so as to snugly contact the racket 10 and markings on the racket head (not shown) indicate proper positioning of the head with member 70. In operation, in order to align the strings within this embodiment, the racket is simply positioned above and parallel to the base with the racket head aligned with member 70 and then lowered until the racket head is seated between the three guide members. It is then pressed further downward forcing the string array over the alignment pin array until the racket is fully in contact with the base.

Thus it can be seen that the present invention provides for a racket string alignment tool which incorporates many novel features and offers significant advantages over the prior art. Although only two embodiments of this invention have been illustrated and described it is to be understood that obvious modifications can be made of them without departing from the true scope and spirit of the invention.

I claim:

1. A tool for aligning the strings of a racket, the racket including a head defining an opening, a first plurality of spaced, nominally parallel strings attached to the head and extending across the opening and a second plurality of spaced, nominally parallel strings also attached to the head and extending across the opening, the two pluralities of strings cooperating to form a checkered array of nominally rectangle apertures, the tool comprising:

a base;

means attached to the base for positioning the racket head in a predetermined location on the base; and a plurality of spaced alignment pins projecting upward from the base for aligning the strings in predetermined positions with respect to the head, said plurality of pins in registry with a corresponding plurality of said apertures.

2. The tool of claim 1 wherein the means for positioning includes a support bracket to the base for pivotally securing the racket head to the base.

3. The tool of claim 2 wherein the means for positioning further includes a positioning pin projecting from the base proximate the support bracket.

4. The tool of claim 1 wherein the means for positioning includes a positioning pin projecting from the base.

5. The tool of claim 1 wherein the means for positioning includes a plurality of spaced guide members for engaging the racket head.

6. The tool of claim 1 wherein the plurality of alignment pins includes a first linearly arranged group and a second linearly arranged group parallel to and spaced from the first group, the pins of the second group being staggered with respect to the pins of the first group.

7. A tool for aligning the strings of a racket, the racket including a head defining an opening, a first plurality of spaced, nominally parallel strings attached to the head and extending across the opening and a second plurality of spaced, nominally parallel strings also attached to the head and extending across the opening, the two pluralities of strings cooperating to form a checkered array of nominally rectangle apertures, the tool comprising:

a base;

means attached to the base for positioning the racket head in a predetermined location on the base, said means including a support bracket for pivotally securing the racket head to the base and a positioning pin projecting upward from the base; and a plurality of spaced alignment pins projecting upward from the base for aligning the strings in predetermined positions with respect to the head.

8. The tool of claim 7 wherein the plurality of alignment pins includes a first linearly arranged group spaced with respect to a reference line and a second linearly arranged group parallel to and spaced from the first group, the second group also being spaced intermediate the first group with respect to the reference line.

9. The tool of claim 8 wherein the means for positioning includes a plurality of spaced guide members, for engaging the racket head.

10. A tool for aligning the strings of a racket, the racket including a head defining an opening, a first plurality of spaced, nominally parallel strings attached to the head and extending across the opening and a second plurality of spaced, nominally parallel strings also attached to the head and extending across the opening, the two pluralities of strings cooperating to form a checkered array of nominally rectangle apertures, the tool comprising:

a base;

means attached to the base for positioning the racket head in a predetermined location on the base, said means including a support bracket for pivotally securing the racket head to the base and a positioning pin projecting upward from the base; and a plurality of spaced alignment pins projecting upward from the base for aligning the strings in predetermined positions with respect to the head wherein the plurality of alignment pins includes a first linearly arranged group spaced with respect to a reference line and a second linearly arranged group parallel to and spaced from the first group, the second group also being spaced intermediate the first group with respect to the reference line, said plurality of pins in registry with a corresponding plurality of said apertures.

* * * * *